US006791591B2

(12) United States Patent
Conwell et al.

(10) Patent No.: US 6,791,591 B2
(45) Date of Patent: Sep. 14, 2004

(54) PRINTHEAD PRESSURE RELIEF MECHANISM

(75) Inventors: Kevin Girard Conwell, Fairfield, IL (US); Matt Adams, Cincinnati, OH (US)

(73) Assignee: Intermec IP Corp., Woodland Hills, CA (US)

( * ) Notice: Subject to any disclaimer, the term of this patent is extended or adjusted under 35 U.S.C. 154(b) by 0 days.

(21) Appl. No.: 10/121,093

(22) Filed: Apr. 11, 2002

(65) Prior Publication Data

US 2003/0035015 A1 Feb. 20, 2003

Related U.S. Application Data

(60) Provisional application No. 60/283,111, filed on Apr. 11, 2001.

(51) Int. Cl.[7] ..... B41J 11/20

(52) U.S. Cl. ..... 347/198; 400/56

(58) Field of Search ..... 347/197, 198, 347/8, 14, 16, 101, 104, 19, 37, 105; 400/56, 55, 58, 59

(56) References Cited

U.S. PATENT DOCUMENTS

| | | | | | |
|---|---|---|---|---|---|
| 4,855,756 | A | * | 8/1989 | Gluck et al. | 347/197 |
| 4,879,566 | A | * | 11/1989 | Hanabusa | 347/198 |
| 5,345,863 | A | * | 9/1994 | Kurata et al. | 347/8 |
| 5,468,076 | A | * | 11/1995 | Hirano et al. | 400/59 |
| 5,918,990 | A | * | 7/1999 | Abumehdi | 400/120.17 |
| 6,294,998 | B1 | * | 9/2001 | Adams et al. | 340/572.8 |

* cited by examiner

*Primary Examiner*—Blaise Mouttet
(74) *Attorney, Agent, or Firm*—Orum & Roth

(57) ABSTRACT

A printhead pressure relief mechanism using a non-mechanical media thickness monitoring apparatus. An increase in media thickness is monitored by an emitter/detector pair, a piezo-electric pressure sensor mounted on the print head, a metal detector or a RFID read/write assembly.

19 Claims, 6 Drawing Sheets

PRINTHEAD PRESSURE RELIEF MECHANISM

This application claims the benefit of U.S. Provisional Application 60/283,111 filed Apr. 11, 2001.

BACKGROUND OF THE INVENTION

1. Field of the Invention

The present invention is directed to printheads, specifically to a printhead having a pressure relief mechanism initiated by the approach of a radio frequency identification (RFID) circuit located on or within the print media.

2. Description of the Related Art

JP 11138941 describes a thermal printer system in which a mechanical sensor is used to detect the presence of a high spot in print media. When the mechanical sensor detects a high spot a head lifting mechanism is activated which moves the printhead to a non-contact position, off of the surface of the print media.

This design is susceptible to premature wear and failure due to repeated mechanical cycling of the sensor between up and down positions and use of a roller and spring. The roller and spring mechanism being susceptible to fowling from stray fibers and other contaminants associated with print media. When a high point is detected, the printhead is completely removed from contact with the print media, removing the ability for printing upon the raised section of print media. The mechanical head lifting mechanism is not adjustable to compensate for use of thicker or thinner overall print media. If too thick a print media is used, it is possible that the sensor will be permanently raised, preventing operation of the printer.

RFID tags typically range between 10–20 mils in thickness. Conventional thermo-printers are capable of printing upon print media with a thickness in the range of 3–12 mils. As an RFID circuit embedded in print media passes a printhead the printhead pressure at the contact point can theoretically increase by as much as six times. Abnormal pressure at the printhead contact point causes premature wear due to increased abrasion and creates an increased opportunity for over heating of the print media against the printhead heater elements. If an even pressure is maintained between the printhead and print medium, continuous printing is enabled and printhead life is extended.

DETAILED DESCRIPTION

Figure 1:
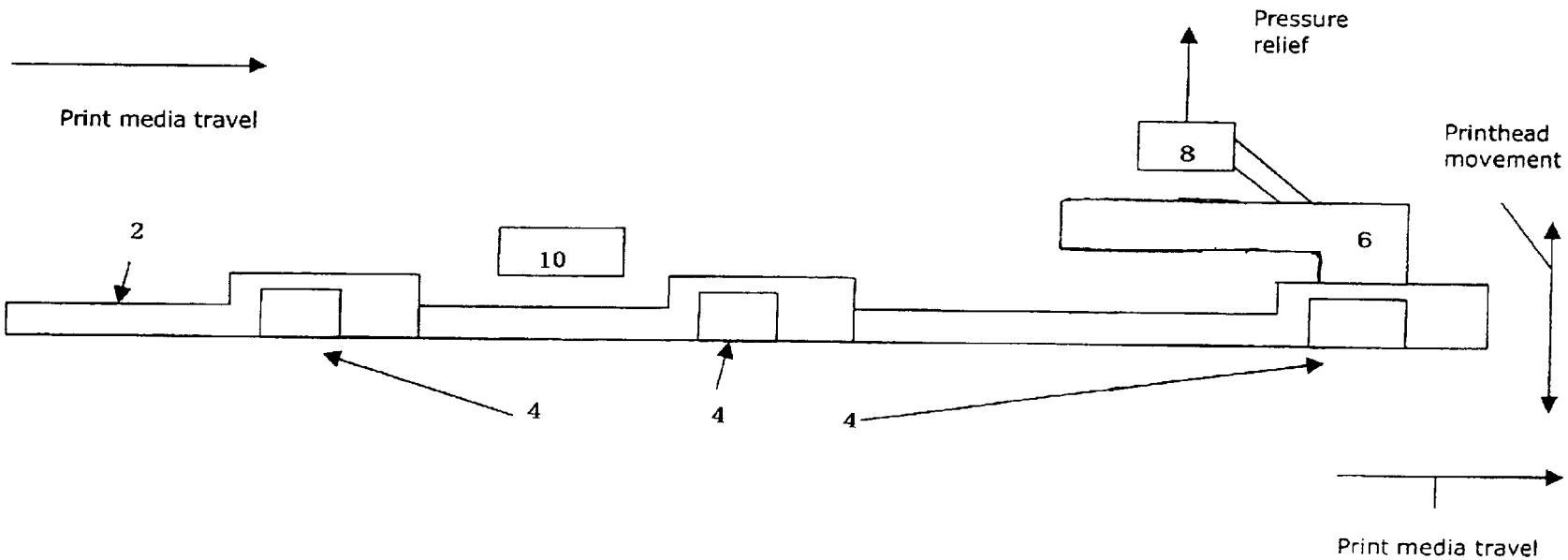
FIG. 1 is a diagram of one embodiment of the invention.
Figure 2:
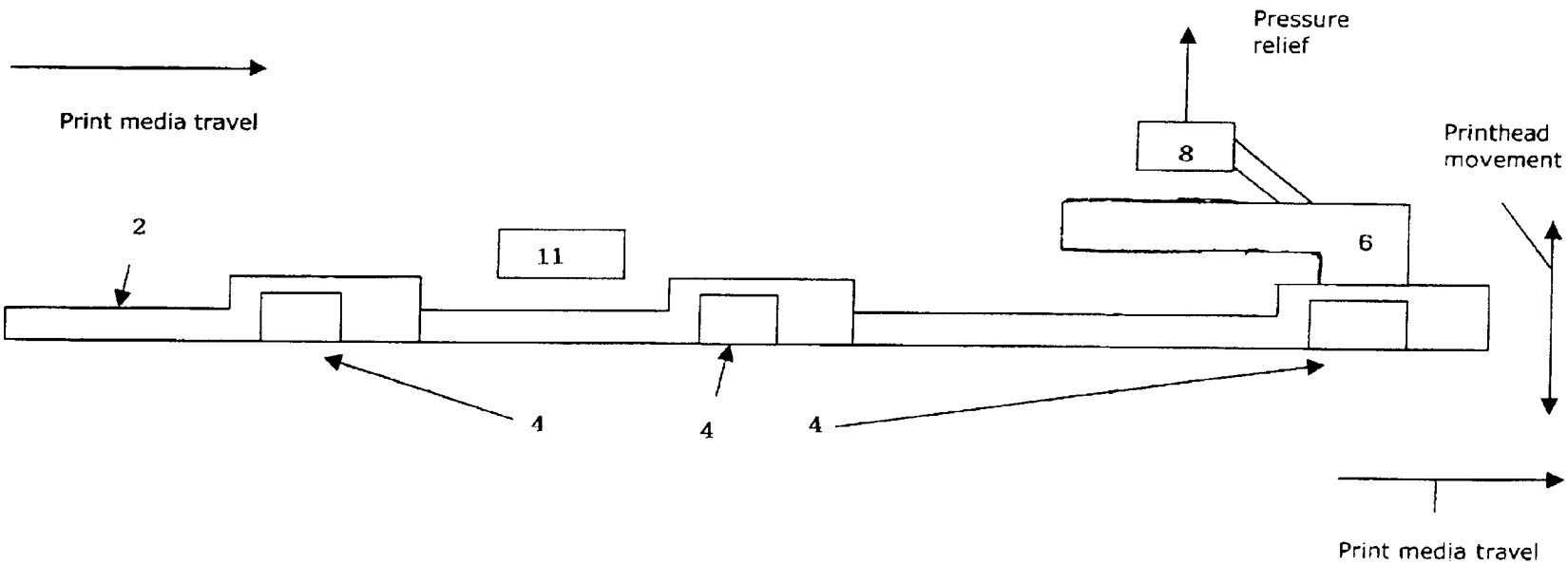
FIG. 2 is a diagram of an alternative embodiment of the invention.
Figure 3:
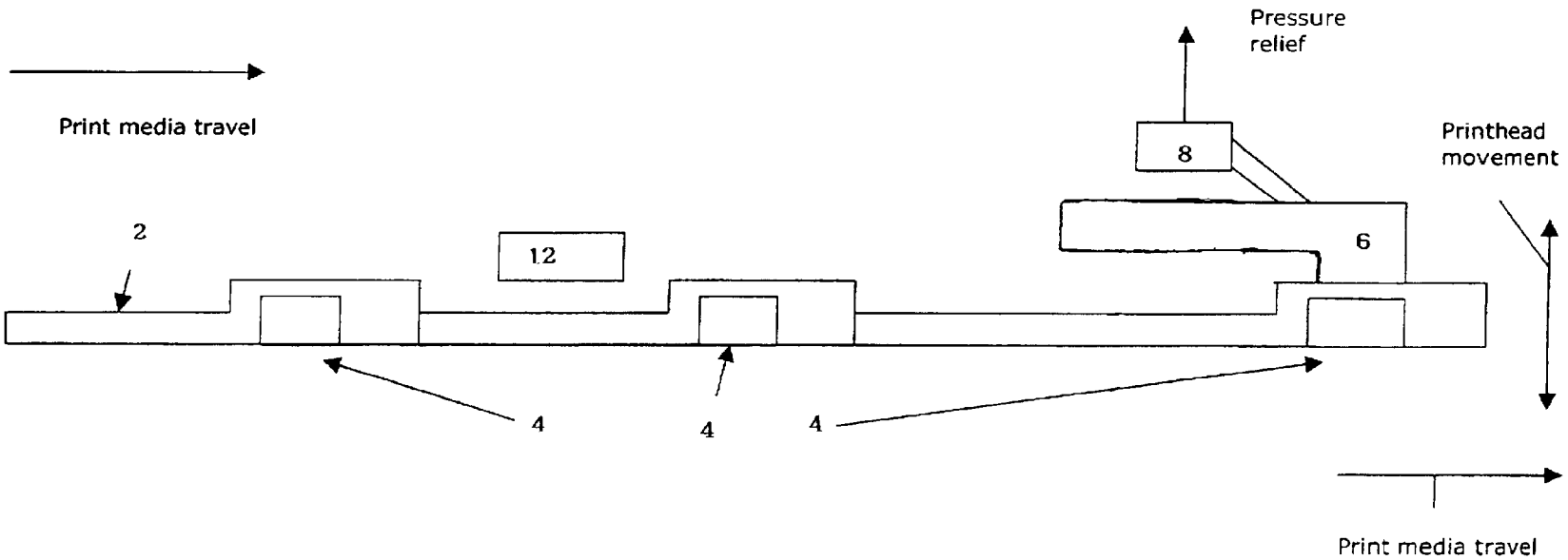
FIG. 3 is a diagram of an alternative embodiment of the invention.
Figure 4:
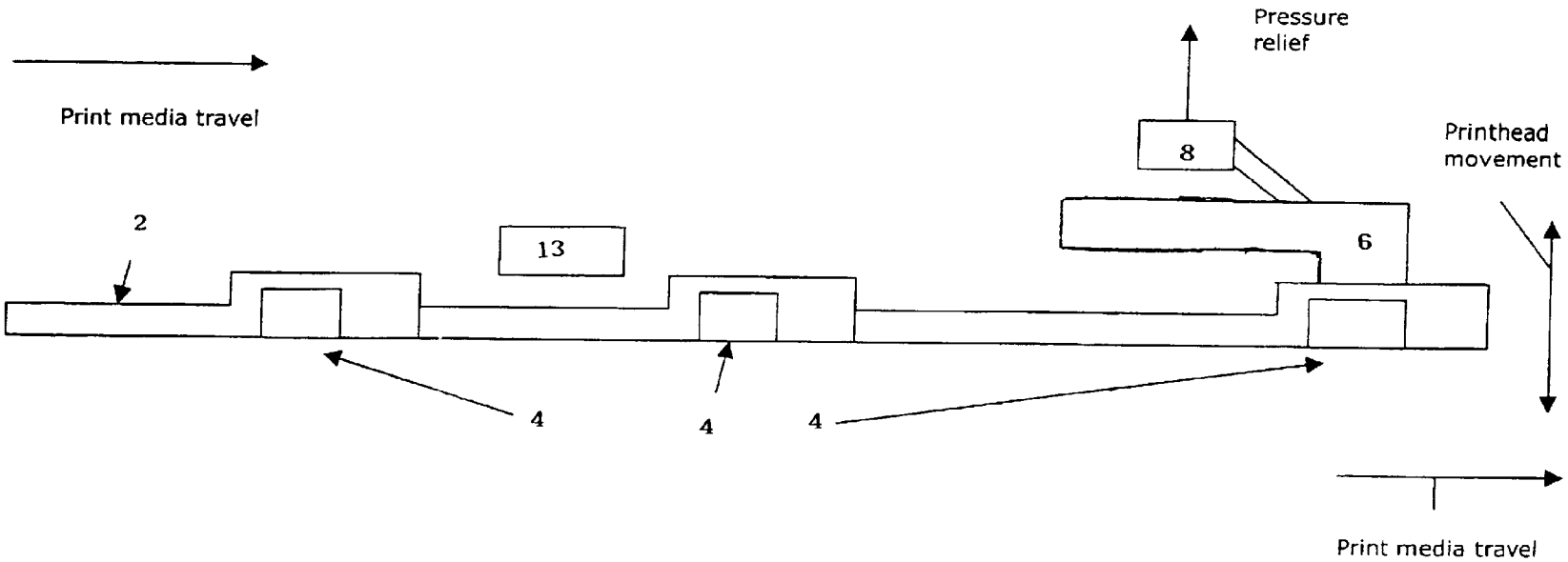
FIG. 4 is a diagram of an alternative embodiment of the invention.
Figure 5:
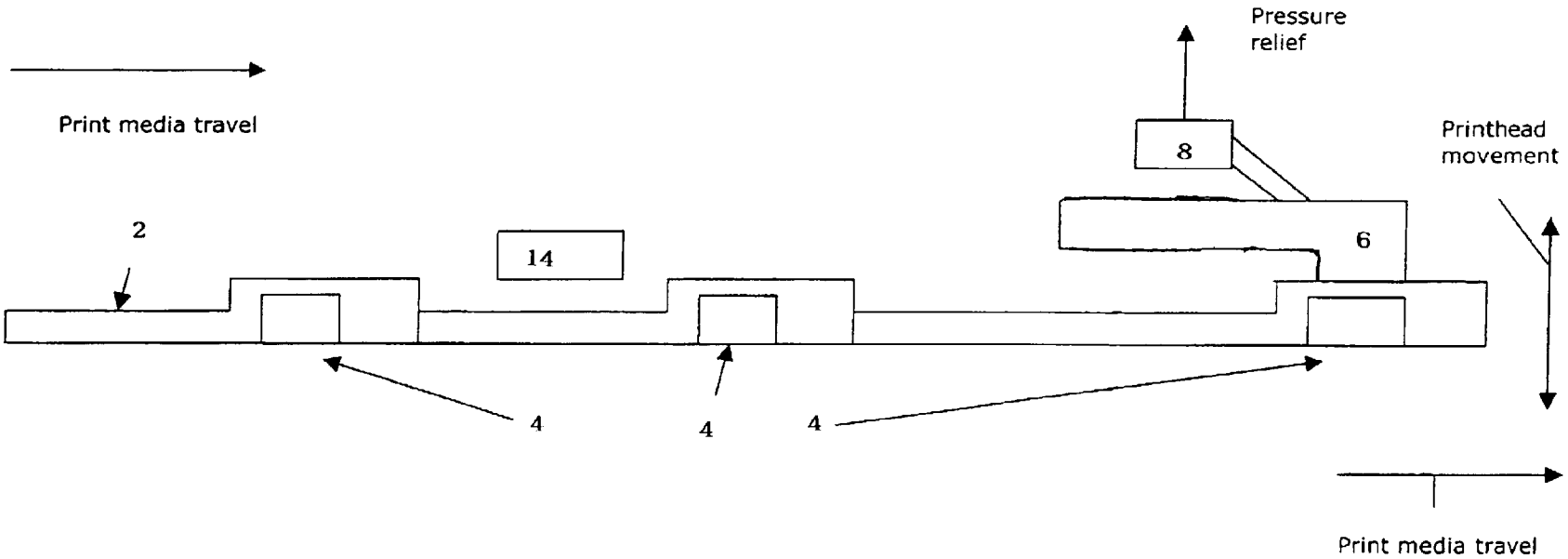
FIG. 5 is a diagram of an alternative embodiment of the invention.
Figure 6:
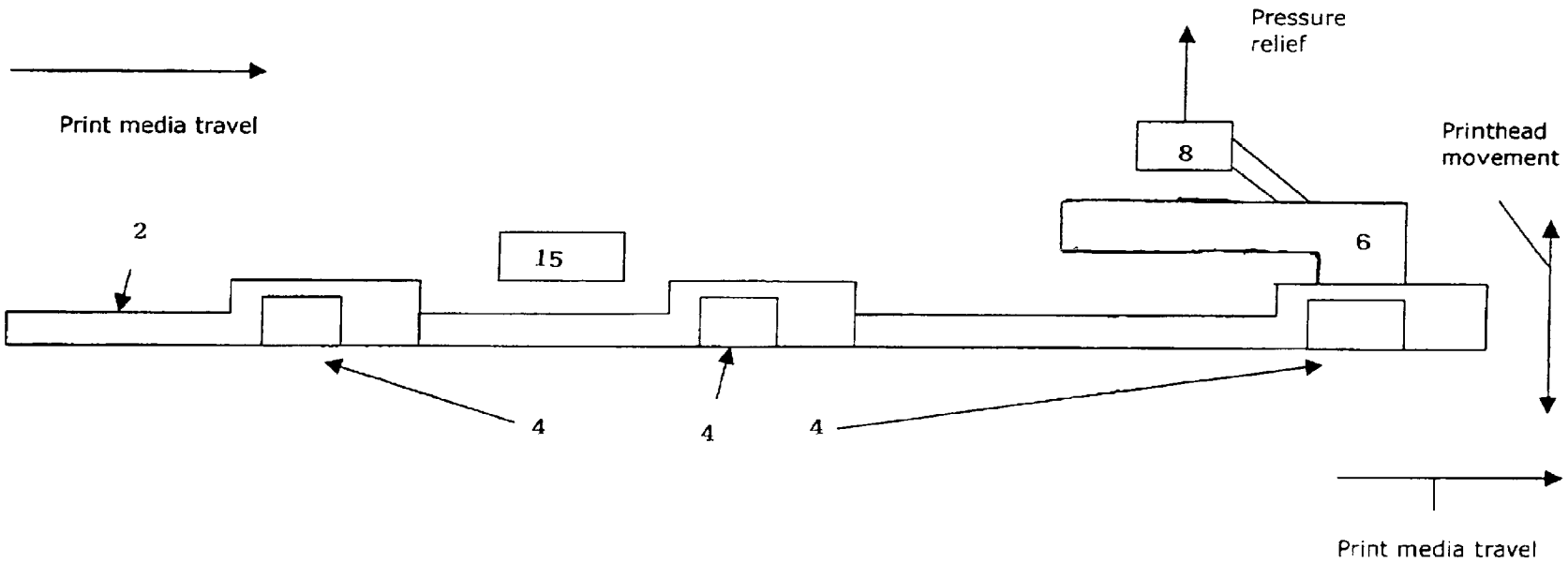
FIG. 6 is a diagram of an alternative embodiment of the invention.

The present invention replaces the previous electro-mechanical sensor with a solid state sensor. Rather than lifting the printhead 6; the present non-obvious invention releases the pressure upon the printhead 6. This enables the printhead 6 to print along the edges of the passing RFID tag

4, for example along the top of the RFID tag 4 and along the failing edge of the RIFD tag. Headwear is minimized by the release of pressure yet printing is not interrupted.

In a first embodiment, the sensor 10 is an array of solid state photocells and LEDs 15 paired to transmit and detect infrared or visible light through the label stock. The sensor (s) are positioned in the immediate path prior to the printhead 6, the full width of the printpath may be covered so that detection of an RFID tag 4 will occur regardless of its location within the print media 2.

In a second embodiment, the sensor 10 may be a piezoelectric pressure 12 sensor. As an embedded RDID 4 passes, the sensor 10 will detect the pressure change caused by the RFID circuit 4 and actuate the printhead pressure relief mechanism 8 to release the pressure holding the printhead 6 in position. The pressure sensor 12 may be located directly on the thermal printhead itself or in the immediate path below the printhead.

In a third embodiment, the read/write antenna 14 used for interacting with the RFID 4 integrated into the print medium 2 may be used as a proximity sensor to detect the location and position of the embedded transponder prior to its arrival at the printhead position. A voltage level representing the signal received from the transponder will vary depending on the distance of the transponder to the antenna, this allows calculation of the antenna location with respect to the transponder.

A fourth embodiment uses a metallic proximity sensor 13 to detect the transponder's antenna.

In a fifth embodiment, the sensor 10 is an emitter and detector 11 arranged so that an intermediate increase in media 2 thickness interrupts a line of sight between the emitter and detector 11.

In all of the sensor embodiments once the location of the RFID tag is detected, the printhead pressure relief may be initiated and then re-engaged for continued printing of the print media after the RFID circuit has passed. Depending on the sensor used, a calculated time delay may be performed to determine the proper instant/period for actuating the pressure relief.

Depending on the type of print media 2 and printhead 6 used the pressure on the printhead may be reduced rather than fully released. A lessened pressure compensating for the increased thickness of print media 2 over an RFID 4 but still maintains enough pressure for clear printing.

The present invention extends the life of the printhead 6 by preventing wear and/or damage to the printhead 6. Also, as no mechanical linkage is included in the sensor 10, an additional failure point and/or maintenance requirement for the printer is eliminated.

The present invention is also usable with print media 2 other than RFID's. Any print media 2 that includes non-planer surfaces, for example, machine and or candy in rolls of individual segmented pouch packaging may utilize this invention.

We claim:

1. A printhead pressure relief assembly comprising:

means for detecting an intermediate increase in thickness of a non-planar media, and a pressure relief mechanism;

whereby upon detection of said intermediate increase in media thickness by the means for detecting, the pressure relief mechanism is actuated; and the printhead remains in contact with the media to permit printing over the non-planar surface of the media.

2. The printhead pressure relief assembly of claim 1 wherein, the means of detecting is an emitter and detector arranged so that an intermediate increase in media thickness interrupts a line of sight between the emitter and the detector.

3. The printhead pressure relief assembly of claim 1 wherein, the means of detecting is a piezo-electric pressure sensor attached to the printhead, whereby an increase in pressure generated by an intermediate increase in media thickness is sensed by the piezo-electric pressure sensor.

4. The printhead pressure release assembly of claim 3 wherein the piezo-electric pressure sensor is located on the printhead.

5. The printhead pressure release assembly of claim 3 wherein the piezo-electric pressure sensor is located in the intermediate path below the printhead.

6. The printhead pressure release assembly of claim 1 wherein the printhead pressure is reduced when the pressure relief mechanism is activated.

7. The printhead pressure release assembly of claim 1 wherein the printhead pressure is released when the pressure mechanism is activated.

8. The printhead pressure relief assembly of claim 1, wherein continuous printing of the non-planar media is enabled.

9. A printhead pressure relief assembly comprising:

means for detecting an RFID tag in a media; and a pressure relief mechanism;

whereby upon detection of said RFID tag, the pressure relief mechanism is actuated.

10. The printhead pressure relief assembly of claim 9 wherein, the means of detecting is a metallic proximity sensor which detects a RFID antenna within the media.

11. The printhead pressure relief assembly of claim 9 wherein, the means for detecting is an antenna.

12. The printhead pressure relief assembly of claim 9 wherein the means for detecting is an array of photocells and LEDs paired to transmit and detect light through the media.

13. The printhead pressure relief assembly of claim 9 wherein the printhead remains in contact with the media to permit printing over a non-planar surface of the media.

14. The printhead pressure relief assembly of claim 9 wherein continuous printing of the media is enabled.

15. The printhead pressure release assembly of claim 9 wherein the printhead pressure is reduced when the pressure relief mechanism is activated.

16. The printhead pressure release assembly of the claim 9 wherein the printhead pressure is released when the pressure mechanism is activated.

17. A method for reducing printhead pressure comprising the steps of obtaining a non-planar media;

detecting an intermediate increase in media thickness;

activating a pressure relief mechanism;

reducing the printhead pressure; and maintaining contact between the media and the printhead.

18. A method for reducing printhead pressure comprising the steps of obtaining a non-planar media;

detecting an intermediate increase in media thickness;

activating a pressure relief mechanism;

reducing the printhead pressure; and calculating a time delay to determine a period for activating the pressure relief mechanism.

19. A method for reducing printhead pressure comprising the steps of obtaining a non-planar media;

detecting an intermediate increase in media thickness;

activating a pressure relief mechanism;

reducing the printhead pressure; and maintaining an even pressure between the printhead and the media as the non-planar media passes the printhead.

* * * * *